US011094521B2

(12) United States Patent
Brown

(10) Patent No.: US 11,094,521 B2
(45) Date of Patent: Aug. 17, 2021

(54) DUAL MODE MASS SPECTROMETER

(71) Applicant: MICROMASS UK LIMITED, Wilmslow (GB)

(72) Inventor: Jeffery Mark Brown, Hyde (GB)

(73) Assignee: MICROMASS UK LIMITED, Wilmslow (GB)

( * ) Notice: Subject to any disclaimer, the term of this patent is extended or adjusted under 35 U.S.C. 154(b) by 0 days.

(21) Appl. No.: 16/341,047

(22) PCT Filed: Oct. 18, 2017

(86) PCT No.: PCT/GB2017/053155
§ 371 (c)(1),
(2) Date: Apr. 10, 2019

(87) PCT Pub. No.: WO2018/073589
PCT Pub. Date: Apr. 26, 2018

(65) Prior Publication Data

US 2019/0237318 A1 Aug. 1, 2019

(30) Foreign Application Priority Data

Oct. 19, 2016 (GB) ..... 1617668

(51) Int. Cl.
*H01J 49/40* (2006.01)
*H01J 49/00* (2006.01)

(52) U.S. Cl.
CPC ..... *H01J 49/405* (2013.01); *H01J 49/0031* (2013.01); *H01J 49/0036* (2013.01); *H01J 49/406* (2013.01); *H01J 49/408* (2013.01)

(58) Field of Classification Search
CPC ..... H01J 49/405
See application file for complete search history.

(56) References Cited

U.S. PATENT DOCUMENTS 5,160,840 A * 11/1992 Vestal ..... H01J 49/405 250/282
6,570,152 B1 5/2003 Hoyes
(Continued)

FOREIGN PATENT DOCUMENTS

EP 1137044 A2 9/2001

OTHER PUBLICATIONS

International Search Report and Written Opinion for International Application No. PCT/GB2017/053155 dated Jan. 30, 2018, 12 pages.

(Continued)

*Primary Examiner* — Michael J Logie
(74) *Attorney, Agent, or Firm* — Kacvinsky Daisak Bluni PLLC

(57) ABSTRACT

Disclosed herein is an ion analysis instrument comprising a Time of Flight ("TOF") mass analyser comprising a reflectron. The instrument is operable in at least a first mode and a second mode, wherein in said first mode ions are caused to turn around at a first point in the reflectron and wherein in said second mode ions are caused to turn around at a second point in the reflectron such that the distance traveled by ions within the Time of Flight mass analyser is greater in the second mode than the distance traveled by ions within the Time of Flight mass analyser in the first mode. In this way, the operating modes can be selectively optimised for the analysis of ions of different masses.

10 Claims, 2 Drawing Sheets

(56) References Cited

U.S. PATENT DOCUMENTS

| | | | | |
|---|---|---|---|---|
| 2005/0098721 | A1 | 5/2005 | Bateman et al. | |
| 2005/0103992 | A1 | 5/2005 | Yamaguchi et al. | |
| 2005/0151076 | A1* | 7/2005 | Yamaguchi | H01J 49/408 250/291 |
| 2006/0219890 | A1* | 10/2006 | Yamaguchi | H01J 49/408 250/287 |
| 2009/0278042 | A1 | 11/2009 | Izumi et al. | |
| 2011/0049350 | A1* | 3/2011 | Vestal | H01J 49/40 250/282 |
| 2014/0138538 | A1* | 5/2014 | Hieftje | H01J 49/34 250/282 |

OTHER PUBLICATIONS

Search Report for United Kingdom Application No. GB1617668.7, dated Feb. 23, 2017, 4 pages.
Combined Search and Examination Report for United Kingdom Application No. GB1717126.5, dated Mar. 1, 2018, 7 pages.

* cited by examiner

DUAL MODE MASS SPECTROMETER

CROSS-REFERENCE TO RELATED APPLICATION

This application is a national phase filing claiming the benefit of and priority to International Patent Application No. PCT/GB2017/053155, filed on Oct. 18, 2017, which claims priority from and the benefit of United Kingdom Application No. 1617668.7 filed on Oct. 19, 2016. The entire contents of these applications are incorporated herein by reference.

FIELD OF THE INVENTION

The present invention relates generally to ion analysis instruments such as mass or ion mobility spectrometers and in particular to ion analysis instruments comprising Time of Flight mass analysers and methods of using the same.

BACKGROUND

Various mass analysers are known that act to analyse ionised material according to mass or mass to charge ratio. A mass analyser may be provided as the analytical component of an ion analysis instrument such as a mass spectrometer, wherein the mass spectrometer may be used to record mass spectra or to obtain mass spectral information e.g. a plot of intensity against mass or mass to charge ratio.

One known type of mass analyser is a Time of Flight ("TOF") mass analyser wherein ions are arranged to separate along a flight path following some initial acceleration with the time taken for an ion to traverse a path of known length being related to the ions' mass to charge ratio. Various types of Time of Flight mass analyser are known, such as reflectron Time of Flight mass analysers wherein ions are arranged to turn around or be reflected back within the flight tube as they travel from the initial acceleration region towards the detector.

Time of Flight mass analysers can suffer from certain limitations, or other potential sources of error, that can result in distortions or aberrations in the recorded mass spectra, e.g. broadening of the spectral peaks.

Various measures are known for reducing the causes and/or effects of these time of flight aberrations in order to enhance the spectral quality and resolution of the instrument.

Mass spectrometers such as Time of Flight mass spectrometers may be used to analyse ions having a wide range of masses or mass to charge ratios, potentially even ions having a wide range of masses or mass to charge ratios within a single sample or experimental run. For example, in the context of monoclonal antibody ("mAb") analysis, or other such biopharmaceutical analyses, it is often important to be able to analyse species having relatively high molecular weights as well as smaller species.

However, conventional mass analysers are not optimised for analysis across a wide range of different molecular weights, particularly because different time of flight aberrations, or limitations of the Time of Flight analyser, may become increasingly relevant as the size or molecular weight of the ions increases (or decreases).

Accordingly, it is desired to provide an improved mass spectrometer.

SUMMARY

According to an aspect there is provided an ion analysis instrument comprising:

a Time of Flight ("TOF") mass analyser comprising a reflectron, wherein the instrument is operable in at least a first mode and a second mode, wherein in said first mode ions are caused to turn around at a first point in the reflectron and wherein in said second mode ions are caused to turn around at a second point in the reflectron such that the distance traveled by ions within the Time of Flight mass analyser is greater in the second mode than the distance traveled by ions within the Time of Flight mass analyser in the first mode.

The instrument is operable in a first mode in which ions travel a first distance within the Time of Flight mass analyser and is further operable in a second mode in which ions travel a second different distance within the Time of Flight mass analyser, wherein the second distance is greater than the first distance. In this way, the first mode may be arranged or substantially optimised for the analysis of high or relatively high molecular weight ions (broadly, "larger" ions), and the second mode may be arranged or substantially optimised for the analysis of low or relatively low molecular weight ions (broadly, "smaller" ions). Therefore, the distance traveled by ions within the Time of Flight mass analyser in the first/second mode may be arranged or may be substantially optimised for the analysis of high/low or relatively high/low molecular weight ions.

The distance traveled by ions in the first and second modes is controlled by causing ions to turn around at different points in the reflectron. For example, in the first mode ions may travel a first distance into the reflectron whereas in the second mode ions travel a greater (second) distance into the reflectron. For instance, by controlling one or more electric fields or potentials applied to the reflectron, it is possible to control the position at which ions turn around (the "ion reversal point"). That is, in the first mode, a first electric field or potential (or set of electric fields or potentials) may be applied to the reflectron to cause ions to turn around at a first point, whereas a second electric field or potential (or set of electric fields or potentials) may be applied in the second mode to cause ions to turn around at a second point.

In embodiments, the distance traveled by ions in the first and second modes is controlled by causing ions to turn around in different stages of a multi-stage reflectron. Accordingly, there may be provided an ion analysis instrument comprising:

a Time of Flight ("TOF") mass analyser comprising a multi-stage reflectron, wherein the instrument is operable in at least a first mode and a second mode, wherein in the first mode ions are caused to turn around in a first stage of the reflectron and wherein in the second mode ions are caused to turn around in a further stage of the reflectron such that the distance traveled by ions within the Time of Flight mass analyser is greater in the second mode than the distance traveled by ions within the Time of Flight mass analyser in the first mode.

The Applicant has recognised through internal research that larger ions experience a greater number of collisions as they travel through a Time of Flight mass analyser than smaller ions, and that for larger ions, e.g. those having relatively high masses or mass to charge ratios (e.g. derived from species having high molecular weights) the effect of these collisions may represent a large, or even dominant, source of error in recorded time of flight spectra.

The Applicant has thus recognised that it may be beneficial to cause larger ions to travel a lesser or shorter distance through the Time of Flight mass analyser than smaller ions.

By reducing the distance traveled, and hence the number of collisions, this potential source of error may be reduced.

Smaller ions, e.g. those having lower masses or mass to charge ratios, typically experience fewer collisions, and the relative contribution of these collisions to the total error in the recorded time of flight spectra may therefore be lower for smaller ions, as other time of flight aberrations may become more relevant. For smaller ions, it may therefore be beneficial for the path length to be as long as practical, in order to reduce other potential sources of time of flight error and to increase the time of flight resolution.

It will be understood that in both cases the ions must still travel a sufficient distance through the Time of Flight mass analyser in order to enable different species to be separated or resolved from each other with a desired resolution so as to allow the components to be distinguished. Typically, the resolution requirements for larger ions are lower than those for smaller ions.

Accordingly, the techniques described herein may relate to a Time of Flight mass analyser operable in two (or more) modes wherein the distance traveled by the ions in the Time of Flight mass analyser in each mode is different. In a first mode, ions are arranged to travel a relatively short distance suitable for analysis of large molecules, whereas in a second mode ions are arranged to travel a relatively long(er) path length suitable for analysis of small molecules.

Accordingly, the first mode may be substantially optimised for the analysis of larger ions by reducing the distance traveled by ions in the Time of Flight mass analyser compared to the distance traveled by the ions in the second mode, so that ions analysed in the first mode may experience fewer collisions with background gas molecules than they would if/when analysed in the second mode, such that the potential effects of these collisions on the time of flight spectra recorded in the first mode are reduced. The instrument may thus be selectively operated in the first mode or the second mode depending on the size of the ions that are desired to be analysed.

It will be appreciated that there may be a trade-off between reducing the number of collisions and potentially introducing other sources of error or losing resolution by reducing the path length. Thus, by "substantially optimised" it is meant that the path length may be selected so that the overall effect is an improvement in the resulting mass spectral data i.e. the mass spectra may show fewer distortions or aberrations.

The distances traveled in the first and second modes may suitably be determined e.g. from prior calibration experiments and/or from theoretical considerations. In general, the substantially optimum path length for heavier ions will be shorter than the substantially optimum path length for lighter ions, as the effects and number of collisions with the background gas would otherwise be a relatively large source of time of flight error for the heavier ions.

Thus, in use, ions may be analysed in different modes depending on their size. For instance, ions having a molecular weight, mass or mass to charge ratio, ion mobility or collision cross section below a certain (first) value may be analysed using the second mode and ions having a molecular weight, mass or mass to charge ratio, ion mobility or collision cross section above that (first) value may be analysed using the first mode. The (first) value may be a pre-determined threshold value, or may be selected as appropriate by the user. The distances traveled by the ions in the first and second modes may be determined or selected (at least in part) on the basis of the first value.

The pressure within the Time of Flight mass analyser may be substantially constant i.e. and/or may be substantially the same in each of the first and second modes.

It will be appreciated that the number of collisions is related to the actual path length traveled by ions within the Time of Flight mass analyser, that is the total distance traveled in the Time of Flight mass analyser before arriving at the detector, and that any references to the distance traveled or path length should therefore be understood in this sense (rather than an effective path length). By the ions travelling different distances in the different modes, it is meant that notionally the same ions would travel different distances in different modes (even if the same ions are not actually analysed in both modes). Considered another way, the maximum distance traveled by ions or maximum possible distance travelable may be different between the different modes.

It will be appreciated that the instrument may be operable or selectively operable between a plurality of modes. For example, the instrument may be selectively operable between the first mode, the second mode and a third or further mode, wherein in each mode ions may be arranged to travel different distances within the Time of Flight mass analyser.

A reflectron is generally a device for causing ions to turn around or to reflect ions, and is typically used to extend the flight path of ions within a Time of Flight mass analyser and/or provide energy focussing of the ions.

The use of reflectrons is well known in the field of Time of Flight mass spectrometry, and various types of reflectron are known. The reflectron used to implement the techniques described herein may generally comprise various suitable reflectrons. For example, the reflectron may comprise an ion mirror. As another example, the reflectron may comprise an electric and/or magnetic sector reflectron.

The reflectron (i.e. or the reflectron fields) may be arranged to focus ions towards the plane of the detector in order to reduce the effect of kinetic energy (U) spread. For example, the reflectron may be used to focus ions to first order and/or to remove the effects of kinetic energy spread on the times of flight of ions to first order (i.e. $dT/dU=0$).

Similarly, a reflectron having two or more stages may be used to focus ions to second order (i.e. $d^2T/dU^2=0$).

Alternatively, the electric fields or potentials applied to the reflectron may be used to (re)introduce first or higher order components in order to reduce the overall residuals.

A multi-stage reflectron is a reflectron comprising two or more stages, such as three or more stages, wherein the stages are arranged sequentially, and wherein a separate electric field or potential may be maintained across each stage. Each stage may be separated from adjacent stages by a grid, wherein an electric field or potential may be applied to the or each grid in order to control the electric field or potential of each respective stage. However, gridless reflectrons are also known (where the stages are not separated by grids), and it is expressly contemplated that the reflectron according to various embodiments may be gridless and/or may comprise one or more gridless stages.

In general, the distance traveled within the Time of Flight mass analyser may be controlled by varying one or more electric fields or potentials applied to one or more components or segments of the Time of Flight mass analyser. The electric fields or potentials applied to the Time of Flight mass analyser, or particularly to one or more components or segments of the Time of Flight mass analyser, may therefore be varied between the first and second modes. That is, in the first mode, one or more first electric fields or potentials may be applied to the Time of Flight mass analyser, or particularly to one or more components or segments of the Time of Flight mass analyser. In the second mode, one or more second electric fields or potentials may be applied to the Time of Flight mass analyser, or particularly to one or more components or segments of the Time of Flight mass analyser. The first and second electric fields or potentials may be arranged to cause ions to travel the different distances within the Time of Flight mass analyser. The instrument may further comprise one or more voltage sources or power circuits for providing and/or controlling such electric fields or potentials. For instance, in embodiments, the distance traveled by ions within the Time of Flight mass analyser between the different modes may be controlled by varying one or more electric fields or potentials applied to the reflectron in order to control the distance traveled by ions within (or into) the reflectron. For example, by applying a steeper electric field to the reflectron, ions may be caused to turn around sooner (i.e. after travelling a relatively shorter distance), whereas applying a shallower electric field, the ions may be caused to travel further into the reflectron.

Thus, the electric fields or potentials maintained across each segment, region or stage of the reflectron may be controlled or varied in order to vary, increase or decrease the distance traveled by ions in the different modes.

In particular, where a multi-stage reflectron is provided, in the first mode, one or more electric fields or potentials may be applied to one or more stages of the multi-stage reflectron so that ions are caused to turn around in a first stage of the reflectron and in the second mode one or more electric fields or potentials may be applied to one or more stages of the multi-stage reflectron so that ions may be caused to turn around in a further stage of the reflectron.

The electric fields or potentials applied to the first and/or further stage(s) of the reflectron may be varied in order to cause ions to turn around in a particular stage. For example, by raising the electric field or potential applied to the first stage in the first mode, substantially all (or all) of the ions may be forced to turn around in the first stage. That is, the electric field or potential applied to the first stage may be increased such that even the most energetic ions are forced to turn around in the first stage and do not pass into any further stage(s). In the second mode, the electric fields or potentials applied to the first and further stage(s) may be arranged so that ions are allowed to pass through the first stage and into a further stage before they turn around. In this way, by controlling the distance traveled into the reflectron, the distance traveled within the Time of Flight mass analyser may be controllably varied between the different modes.

It will be appreciated that the first stage does not necessarily mean the first stage that the ions encounter at the entrance of the reflectron but that "first" is merely a placeholder denoting a particular stage. The further stage may be any stage downstream of the first stage (i.e. further away from the entrance of the reflectron), such that causing the ions to pass into the further stage means that ions travel a greater distance into the reflectron.

Although in a typical multi-stage reflectron the various stages are physically adjacent to each other, it will be appreciated that the stages need not be physically adjacent and may e.g. be separated by one or more field-free regions.

It is also contemplated that a plurality of reflectrons may be arranged in line along the flight path, wherein in the first mode ions are caused to turn around in a first reflectron and wherein in the second mode ions are caused to turn around in a further reflectron such that the distance traveled by ions in the second mode is greater than the distance traveled by ions in the first mode. For example, the reflectron fields in the first reflectron may be turned OFF in the second mode so that the flight of the ions through the first reflectron is substantially unimpeded such that the ions travel onwards to the second reflectron where they are caused to turn around.

The Time of Flight mass analyser may comprise a multi-pass or multi-turn Time of Flight mass analyser and/or may comprise a plurality of reflectrons.

A multi-pass or multi-turn Time of Flight mass analyser is one where the ions turn around multiple times as they travel between the acceleration region and the detector of the Time of Flight mass analyser. Each reflectron, or each part of the multi-pass or multi-turn reflectron, may comprise a multi-stage reflectron substantially as described above, and each reflectron, or each part of the multi-pass or multi-turn reflectron, may be operated so as to allow ions to travel different distances therein.

The ions may be caused to travel through or into a different number of reflectrons in the first and second modes. The ions may be caused to travel different distances into at least some of the plurality of reflectrons in the first and second modes. The use of multiple reflectrons, or multi-pass or multi-turn Time of Flight mass analysers may thus allow for an additional further control over the distance traveled in the different modes i.e. or may allow further or additional modes having different distances.

The Time of Flight mass analyser may comprise a plurality of reflectrons arranged along the flight path. The arrangement of the reflectrons may define the flight path, which may take on a substantially "V", "Z" or "W" shape, or a zig-zag, such that ions are passed from one side of the Time of Flight region to the opposite side between the reflectrons or reflections. For instance, the ions may be reflected to and fro between first and second ion reflectors in the manner described in U.S. Pat. No. 6,570,152 (HOYES).

HOYES discloses a time of flight mass spectrometer with selectable drift length, wherein the drift length is controlled by adjusting the number of reflections taken by the ions. This is controlled by adjusting the inclination angle of ions pulsed into the time of flight region. In HOYES, there is always a compromise between resolution and sensitivity as each additional reflection causes further ions to be lost. By contrast, in the techniques described herein, the path length is adjusted between the first and second modes by causing ions to turn around at different points within (e.g. in different stages of) a (single) reflectron. Thus, the path length may be optimised for ions having different sizes without sacrificing sensitivity. Furthermore, HOYES does not recognise the concept of providing different path lengths for different size ions.

The ions may be (re)focussed along the flight path to account for any dispersion in the reflectron, particularly where a multi-pass or multi-turn Time of Flight mass analyser is provided.

The instrument may be selectively operable between at least the first mode and the second mode.

The first and second (and third or further modes where provided) may typically be discrete modes of operation, wherein the distance traveled by the ions in each mode is fixed and reproducible. For example, where a multi-stage reflectron is provided, ions may be arranged to travel into and/or turn around in different stages of the reflectron, such that in the first mode ions are arranged to travel into and/or turn around in a first stage, in a second mode ions are arranged to travel into and/or turn around in a second stage, and so on. In this way, the distance traveled in each mode may be controlled or fixed by the relative lengths of the stages. The user or instrument may then select which of the discrete modes to use to analyse a particular group of ions.

However, it is also contemplated that the distances traveled in the different modes may be varied dynamically, or in a data-dependent manner. For example, where ions arrive at the Time of Flight mass analyser sequentially (e.g. in order of their molecular weight, mass or mass to charge ratio, ion mobility or collision cross section) the instrument may be arranged to progressively vary, increase or decrease (as appropriate) the distance traveled by the ions in the Time of Flight mass analyser. For example, the distance traveled by the ions may be progressively varied, increased or decreased in a stepped, continuous, discontinuous or other manner during the course of an experiment.

The instrument may further comprise a control system arranged and adapted to select between the first and second modes of operation based (at least in part) on the molecular weight, mass or mass to charge ratio of ions being analysed.

The instrument may further comprise a separation or filtering device for separating or filtering ions or analyte material from which the ions derive according to one or more physico-chemical properties prior to their arrival at the Time of Flight mass analyser.

The one or more physico-chemical properties may include molecular weight, mass, mass to charge ratio, or a mass or mass to charge ratio correlated property such as ion mobility or collision cross section.

Where the molecular weight, mass or mass to charge ratio, ion mobility or collision cross section of ions being analysed is known, or has been determined upstream of the Time of Flight mass analyser, the instrument (or a user) may then select either the first mode or the second mode (or a third or further mode, where provided) appropriately according to the techniques described herein. That is, the instrument (or a user) may select the most appropriate mode for a group of ions having a particular molecular weight, mass or mass to charge ratio, ion mobility or collision cross section, or range of molecular weights, masses or mass to charge ratios, ion mobilities or collision cross sections, so that the distance traveled by ions is substantially optimised or otherwise set for the ions in the group. The control system may comprise various suitable processing circuitry, or one or more processors, arranged to switch modes (e.g. by changing one or more voltages applied to one or more segments of the Time of Flight mass analyser) upon detection or input of the molecular weight, mass or mass to charge ratio, ion mobility or collision cross section of the ions being analysed. The control system may comprise a computer, and may be implemented via suitable software.

The separation or filtering device may comprise a mass or mass to charge ratio separation or filtering device for separating or filtering ions according to mass or mass to charge ratio. As one example, the separation or filtering device may comprise an ion trap with mass selective ejection. The separation or filtering device may additionally or alternatively comprise an ion mobility or differential ion mobility separation or filtering device for separating or filtering ions according to ion mobility or differential ion mobility. The instrument may additionally, or alternatively, comprise a chromatography or other separation device upstream of an ion source for separating or filtering analyte material from which the ions derive. The chromatography separation device may comprise a liquid chromatography or gas chromatography device. Alternatively, the separation device may comprise: (i) a Capillary Electrophoresis ("CE") separation device; (ii) a Capillary Electrochromatography ("CEC") separation device; (iii) a substantially rigid ceramic-based multilayer microfluidic substrate ("ceramic tile") separation device; or (iv) a supercritical fluid chromatography separation device.

The instrument may further comprise a control system arranged and adapted to alternately record mass spectra in the first mode and in the second mode.

The control system may be arranged and adapted to repeatedly and/or automatically switch between the first mode and the second mode.

The instrument may be arranged to repeatedly and/or automatically switch between the first and second modes during the course of a single experiment e.g. during the course of a single liquid chromatography ("LC") or ion mobility introduction.

The instrument may be arranged to automatically switch between the first and second modes during the course of a single Time of Flight mass analysis, such that the lightest (fastest) ions in a particular ion packet pushed into the Time of Flight mass analyser at a certain time are analysed in the first mode whereas heavier (slower) ions in that packet are analysed in the second mode. This approach may result in the loss or defocussing of some ions during the switch, but this may be tolerable where the ions of interest are only at the upper and lower ends of the range.

The Time of Flight mass analyser may comprise an acceleration region, wherein ions are accelerated into the Time of Flight mass analyser by a pusher field applied at the acceleration region, wherein the pusher field is varied between the first and second modes.

Varying the pusher field allows spatial focussing at the or a detector to be maintained between the first and second modes as the path length is varied. For example, in the second mode, where the path length is shorter, the pusher field may be reduced in order to extend the spatial focus point relative to the first mode.

The Time of Flight mass analyser may comprise one or more detectors located at the end of the ions' flight path. Typically, a single detector may be used to detect ions in both the first and second modes. Where a single detector is used, the axial energy of the ions may be adjusted between the first and second modes. Alternatively, the Time of Flight mass analyser may comprise a plurality of (i.e. two or more) detectors, wherein different detectors may be used to record spectra in different modes.

According to another aspect there is provided a method of ion analysis comprising: providing an instrument substantially as described above in relation to any of the aspects or embodiments of the present disclosure; and analysing ions in the Time of Flight mass analyser using the first mode and/or using the second mode.

The method may comprise selectively analysing ions using the first mode and/or the second mode based on the molecular weight, mass or mass to charge ratio, ion mobility or collision cross section of ions being analysed.

The method may comprise separating the ions or separating analyte material from which the ions are derived according to molecular weight, mass, mass to charge ratio, or a mass or mass to charge ratio correlated property such as ion mobility or collision cross section prior to passing the ions to the Time of Flight mass analyser.

The method may comprise analysing ions having a molecular weight, mass or mass to charge ratio, ion mobility or collision cross section below a first value in the first mode.

The method may comprise analysing ions having a molecular weight, mass or mass to charge ratio, ion mobility or collision cross section above the or a first value in the second mode.

According to another aspect there is provided an ion analysis instrument operable in a first mode of operation wherein ions experience a first pressure-path length product ($P_1xL_1$) and further operable in a second mode of operation wherein ions experience a second different pressure-path length product ($P_2xL_2$).

According to various embodiments either: (i) $P_1=P_2$ and $L_1\neq L_2$; (ii) $P_1\neq P_2$ and $L_1=L_2$; or (iii) $P_1\neq P_2$ and $L_1\neq L_2$.

According to another aspect there is provided a method of analysing ions comprising operating an ion analysis instrument in a first mode of operation wherein ions experience a first pressure-path length product ($P_1xL_1$) and further operating the ion analysis instrument in a second mode of operation wherein ions experience a second different pressure-path length product ($P_2xL_2$).

According to various embodiments either: (i) $P_1=P_2$ and $L_1\neq L_2$; (ii) $P_1\neq P_2$ and $L_1=L_2$; or (iii) $P_1\neq P_2$ and $L_1\neq L_2$.

According to yet another aspect there is provided an ion analysis instrument comprising: a Time of Flight ("TOF") mass analyser, wherein the instrument is operable in at least a first mode and a second mode, wherein the distance traveled by ions within the Time of Flight mass analyser is greater in the second mode than the distance traveled by ions within the Time of Flight mass analyser in the first mode.

The ion analysis instrument of these further aspects may comprise any of the features described herein in relation to any of the other embodiments or aspects at least to the extent that they are not mutually incompatible. The ion analysis instrument of this further aspect may further be arranged, or include a control system arranged and adapted, to implement any of the functionality or method steps described herein.

The ion analysis instruments described herein according to any of the aspects or embodiments may be mass and/or ion mobility spectrometers.

The instrument may comprise an ion source selected from the group consisting of: (i) an Electrospray ionisation ("ESI") ion source; (ii) an Atmospheric Pressure Photo Ionisation ("APPI") ion source; (iii) an Atmospheric Pressure Chemical Ionisation ("APCI") ion source; (iv) a Matrix Assisted Laser Desorption Ionisation ("MALDI") ion source; (v) a Laser Desorption Ionisation ("LDI") ion source; (vi) an Atmospheric Pressure Ionisation ("API") ion source; (vii) a Desorption Ionisation on Silicon ("DIOS") ion source; (viii) an Electron Impact ("EI") ion source; (ix) a Chemical Ionisation ("CI") ion source; (x) a Field Ionisation ("FI") ion source; (xi) a Field Desorption ("FD") ion source; (xii) an Inductively Coupled Plasma ("ICP") ion source; (xiii) a Fast Atom Bombardment ("FAB") ion source; (xiv) a Liquid Secondary Ion Mass Spectrometry ("LSIMS") ion source; (xv) a Desorption Electrospray Ionisation ("DESI") ion source; (xvi) a Nickel-63 radioactive ion source; (xvii) an Atmospheric Pressure Matrix Assisted Laser Desorption Ionisation ion source; (xviii) a Thermospray ion source; (xix) an Atmospheric Sampling Glow Discharge Ionisation ("ASGDI") ion source; (xx) a Glow Discharge ("GD") ion source; (xxi) an Impactor ion source; (xxii) a Direct Analysis in Real Time ("DART") ion source; (xxiii) a Laserspray Ionisation ("LSI") ion source; (xxiv) a Sonicspray Ionisation ("SSI") ion source; (xxv) a Matrix Assisted Inlet Ionisation ("MAII") ion source; (xxvi) a Solvent Assisted Inlet Ionisation ("SAII") ion source; (xxvii) a Desorption Electrospray Ionisation ("DESI") ion source; (xxviii) a Laser Ablation Electrospray Ionisation ("LAESI") ion source; and (xxix) Surface Assisted Laser Desorption Ionisation ("SALDI").

The instrument may comprise one or more continuous or pulsed ion sources.

The instrument may comprise one or more ion guides.

The instrument may comprise one or more ion mobility separation devices and/or one or more Field Asymmetric Ion Mobility Spectrometer devices.

The instrument may comprise one or more ion traps or one or more ion trapping regions.

The instrument may comprise one or more collision, fragmentation or reaction cells selected from the group consisting of: (i) a Collisional Induced Dissociation ("CID") fragmentation device; (ii) a Surface Induced Dissociation ("SID") fragmentation device; (iii) an Electron Transfer Dissociation ("ETD") fragmentation device; (iv) an Electron Capture Dissociation ("ECD") fragmentation device; (v) an Electron Collision or Impact Dissociation fragmentation device; (vi) a Photo Induced Dissociation ("PID") fragmentation device; (vii) a Laser Induced Dissociation fragmentation device; (viii) an infrared radiation induced dissociation device; (ix) an ultraviolet radiation induced dissociation device; (x) a nozzle-skimmer interface fragmentation device; (xi) an in-source fragmentation device; (xii) an in-source Collision Induced Dissociation fragmentation device; (xiii) a thermal or temperature source fragmentation device; (xiv) an electric field induced fragmentation device; (xv) a magnetic field induced fragmentation device; (xvi) an enzyme digestion or enzyme degradation fragmentation device; (xvii) an ion-ion reaction fragmentation device; (xviii) an ion-molecule reaction fragmentation device; (xix) an ion-atom reaction fragmentation device; (xx) an ion-metastable ion reaction fragmentation device; (xxi) an ion-metastable molecule reaction fragmentation device; (xxii) an ion-metastable atom reaction fragmentation device; (xxiii) an ion-ion reaction device for reacting ions to form adduct or product ions; (xxiv) an ion-molecule reaction device for reacting ions to form adduct or product ions; (xxv) an ion-atom reaction device for reacting ions to form adduct or product ions; (xxvi) an ion-metastable ion reaction device for reacting ions to form adduct or product ions; (xxvii) an ion-metastable molecule reaction device for reacting ions to form adduct or product ions; (xxviii) an ion-metastable atom reaction device for reacting ions to form adduct or product ions; and (xxix) an Electron Ionisation Dissociation ("EID") fragmentation device.

The ion-molecule reaction device may be configured to perform ozonolysis for the location of olefinic (double) bonds in lipids.

The instrument may comprise one or more ion detectors.

The instrument may comprise one or more mass filters selected from the group consisting of: (i) a quadrupole mass filter; (ii) a 2D or linear quadrupole ion trap; (iii) a Paul or 3D quadrupole ion trap; (iv) a Penning ion trap; (v) an ion trap; (vi) a magnetic sector mass filter; (vii) a Time of Flight mass filter; and (viii) a Wien filter.

The instrument may comprise a device or ion gate for pulsing ions; and/or a device for converting a substantially continuous ion beam into a pulsed ion beam.

The instrument may comprise a C-trap and a mass analyser comprising an outer barrel-like electrode and a coaxial inner spindle-like electrode that form an electrostatic field with a quadro-logarithmic potential distribution, wherein in a first mode of operation ions are transmitted to the C-trap and are then injected into the mass analyser and wherein in a second mode of operation ions are transmitted to the C-trap and then to a collision cell or Electron Transfer Dissociation device wherein at least some ions are fragmented into fragment ions, and wherein the fragment ions are then transmitted to the C-trap before being injected into the mass analyser.

The instrument may comprise a stacked ring ion guide comprising a plurality of electrodes each having an aperture through which ions are transmitted in use and wherein the spacing of the electrodes increases along the length of the ion path, and wherein the apertures in the electrodes in an upstream section of the ion guide have a first diameter and wherein the apertures in the electrodes in a downstream section of the ion guide have a second diameter which is smaller than the first diameter, and wherein opposite phases of an AC or RF voltage are applied, in use, to successive electrodes.

The instrument may comprise a device arranged and adapted to supply an AC or RF voltage to the electrodes. The AC or RF voltage optionally has an amplitude selected from the group consisting of: (i) about <50 V peak to peak; (ii) about 50-100 V peak to peak; (iii) about 100-150 V peak to peak; (iv) about 150-200 V peak to peak; (v) about 200-250 V peak to peak; (vi) about 250-300 V peak to peak; (vii) about 300-350 V peak to peak; (viii) about 350-400 V peak to peak; (ix) about 400-450 V peak to peak; (x) about 450-500 V peak to peak; and (xi) >about 500 V peak to peak.

The AC or RF voltage may have a frequency selected from the group consisting of: (i) <about 100 kHz; (ii) about 100-200 kHz; (iii) about 200-300 kHz; (iv) about 300-400 kHz; (v) about 400-500 kHz; (vi) about 0.5-1.0 MHz; (vii) about 1.0-1.5 MHz; (viii) about 1.5-2.0 MHz; (ix) about 2.0-2.5 MHz; (x) about 2.5-3.0 MHz; (xi) about 3.0-3.5 MHz; (xii) about 3.5-4.0 MHz; (xiii) about 4.0-4.5 MHz; (xiv) about 4.5-5.0 MHz; (xv) about 5.0-5.5 MHz; (xvi) about 5.5-6.0 MHz; (xvii) about 6.0-6.5 MHz; (xviii) about 6.5-7.0 MHz; (xix) about 7.0-7.5 MHz; (xx) about 7.5-8.0 MHz; (xxi) about 8.0-8.5 MHz; (xxii) about 8.5-9.0 MHz; (xxiii) about 9.0-9.5 MHz; (xxiv) about 9.5-10.0 MHz; and (xxv) >about 10.0 MHz.

A chromatography detector may be provided, wherein the chromatography detector comprises either:

a destructive chromatography detector optionally selected from the group consisting of (i) a Flame Ionization Detector (FID); (ii) an aerosol-based detector or Nano Quantity Analyte Detector (NQAD); (iii) a Flame Photometric Detector (FPD); (iv) an Atomic-Emission Detector (AED); (v) a Nitrogen Phosphorus Detector (NPD); and (vi) an Evaporative Light Scattering Detector (ELSD); or a non-destructive chromatography detector optionally selected from the group consisting of: (i) a fixed or variable wavelength UV detector; (ii) a Thermal Conductivity Detector (TCD); (iii) a fluorescence detector; (iv) an Electron Capture Detector (ECD); (v) a conductivity monitor; (vi) a Photoionization Detector (PID); (vii) a Refractive Index Detector (RID); (viii) a radio flow detector; and (ix) a chiral detector.

The instrument may be operated in various modes of operation including a mass spectrometry ("MS") mode of operation; a tandem mass spectrometry ("MS/MS") mode of operation; a mode of operation in which parent or precursor ions are alternatively fragmented or reacted so as to produce fragment or product ions, and not fragmented or reacted or fragmented or reacted to a lesser degree; a Multiple Reaction Monitoring ("MRM") mode of operation; a Data Dependent Analysis ("DDA") mode of operation; a Data Independent Analysis ("DIA") mode of operation a Quantification mode of operation or an Ion Mobility Spectrometry ("IMS") mode of operation.

BRIEF DESCRIPTION OF THE DRAWINGS

Various embodiments will now be described, by way of example only, and with reference to the accompanying drawings in which.

DETAILED DESCRIPTION

Figure 1:
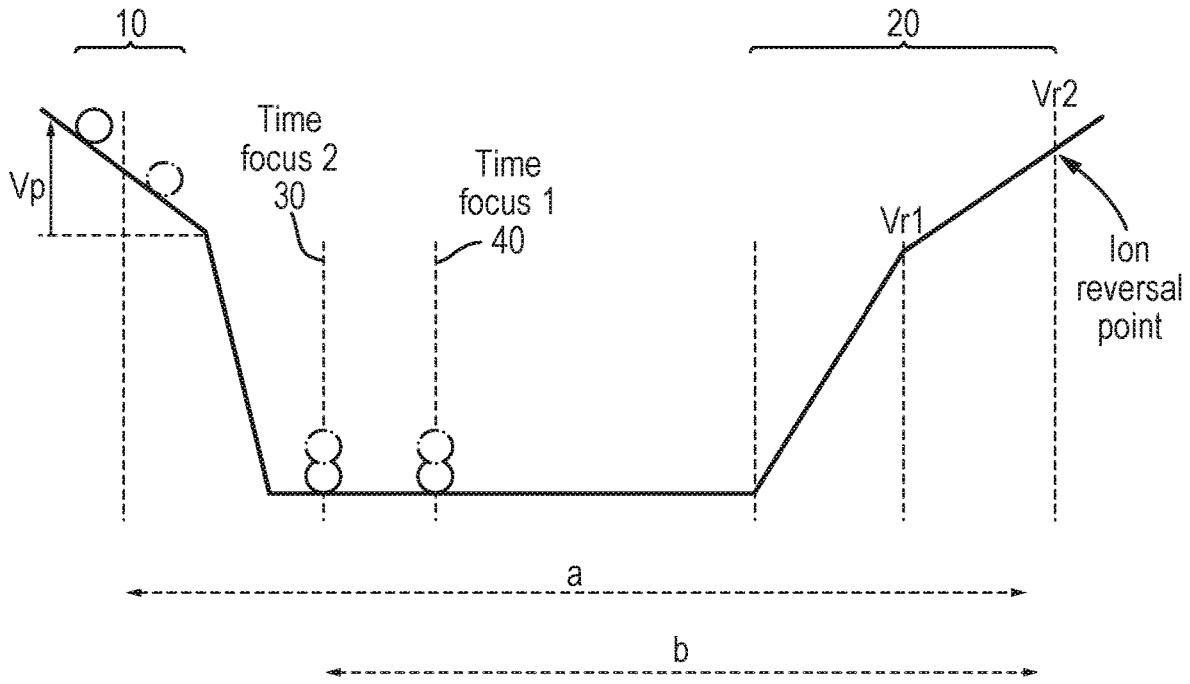
FIG. 1 shows schematically a multi-stage reflectron Time of Flight mass spectrometer according to an embodiment operating in a first mode arranged for analysing ions having low molecular weights.

Embodiments will now be described with particular reference to multi-stage reflectron based Time of Flight mass spectrometer systems. However, it should be understood that the teachings described herein may also be applied to various other suitable ion analysis instruments or mass spectrometer systems.

Generally, the concepts described herein involve providing an ion analysis instrument wherein the path length that ions taken as they travel through the analysis instrument may be changed or controlled so as to improve the performance of the analyser for a certain mass, mass to charge ratio or molecular weight or a certain mass, mass to charge ratio or molecular weight range of ions. Thus, the path length in a first mode may be selected to improve the analysis of low molecular weight ions and the path length in a second mode may be selected to improve the analysis of high(er) molecular weight ions. That is, ion analysis instruments are disclosed that are selectively operable in at least two different modes wherein the distance traveled by ions within a Time of Flight mass analyser of the instrument is different in different modes, such that the distances traveled by ions in the different modes may be selected to be appropriate for ions having different molecular weights, or different ranges of molecular weights. The path lengths in the different modes may thus be chosen so as to substantially optimise or improve the analysis of ions having different molecular weights.

In conventional Time of Flight mass analysers a single fixed path length is generally used to analyse both large and small ions, and this path length is generally chosen to be as long as possible to maximise the resolution of the Time of Flight mass analyser.

Conventionally, no account is typically taken of potential sources of error or time of flight aberrations that become relevant for ions of different sizes.

Whilst it may be beneficial for relatively small ions to travel a long distance within a Time of Flight mass analyser, the Applicant has recognised that for time of flight analysis of larger ions, it may be beneficial to reduce the distance traveled within the Time of Flight mass analyser (whilst still ensuring that the distance traveled is sufficient to separate the different ions). That is, the Applicant has recognised that it may be beneficial to arrange for larger ions to travel a shorter distance within the Time of Flight mass analyser compared with smaller ions. This approach goes against conventional thinking that all ions irrespective of their mass to charge ratio should be arranged to travel as far as possible in order to maximise the amount of separation.

In particular, the Applicant has recognised that for larger ions the effects of collisions with background gas molecules within the Time of Flight mass analyser may become a dominant source of error which may outweigh any potential advantages associated with increasing the path length.

On the other hand, for smaller ions, where there are typically fewer collisions with background gas molecules, the effects of these collisions may be less relevant, such that the potential advantages associated with the increased path length may be more important. It will be appreciated that there may generally be some compromise between these competing effects and the substantially optimum path length may be that which minimises the total error from all sources (for a given mass, mass to charge ratio, or molecular weight or range of mass, mass to charge ratio, or molecular weight). Suitable path lengths for a particular Time of Flight mass analyser may thus be determined e.g. using prior calibration experiments, or from theoretical considerations. In general, the optimum path length for larger ions may be shorter than the optimum path length for smaller ions.

The average number of collisions, Nc, experienced by an ion within a time of flight region may e.g. be determined by mean free path calculations as:

$$Nc=k\cdot A\cdot P\cdot L \quad (1)$$

wherein A is the collision cross section of the ion of interest (in $Å^2$, wherein 1 Angstrom (Å)=$10^{-10}$ m), P is the pressure in mbar, L is the actual path length in meters that ion travels in the Time of Flight analyser (that is the total distance traveled, including any distance traveled into a reflectron, rather than an effective path length) and k is a constant of proportionality, here k=241 $Å^{-2}$ $m^{-1}$ $mbar^{-1}$.

The collision cross section ("CCS") of an ion tends to increase with size, and so larger molecular ions generally have a larger collision cross section, and are therefore more likely to collide with the residual background gas molecules within the Time of Flight analyser than smaller ions. For instance, CCS may be approximated from the mass, m, of a species by the relationship $CCS\approx B\cdot m^{2/3}$, where B is some constant of proportionality. Thus, the CCS, if not already known or measured (e.g. by an ion mobility separation device), and hence probability of collision, may be estimated from the mass of the ions as may be determined using the Time of Flight mass analyser or some other mass analyser. For example, the Time of Flight mass analyser may be used to determine the mass to charge ratio of ions, and based on knowledge or determination of the charge state, the mass may thus also be determined.

Collisions of analyte species with background gas molecules may lead to scattering, which may in turn result in a broadening of the spectral peaks. Thus, the ions' change in velocity upon colliding with background gas molecules is one source of error or aberration in the Time of Flight mass spectra. These collisions may also involve a release of energy e.g. due to dissociation of the ions. Various collisional processes involving a release of energy are known such as the so-called "Derrick" shift. Again, these processes represent a potential source of time of flight error as any change in energy will have an effect on the Time of Flight measurement, potentially distorting or broadening the peaks in the Time of Flight mass spectra. Empirical measurements indicate that the amount of scattering and the levels of chemical noise in the mass spectra (such as the percent valley "hump") are almost directly related to the number of collisions.

In view of the above, the Time of Flight mass analyser may be maintained under high vacuum conditions e.g. between around $10^{-5}$ to $10^{-8}$ mbar in order to reduce the average number of collisions as far as possible.

However, for larger molecular weight ions, or ions having larger collision cross sections, the average number of collisions under typical Time of Flight mass analyser operating conditions may still be undesirably high. For example, for a large molecular weight ion such as a monoclonal antibody having a collision cross section of ~7000 $Å^2$, with a time of flight length of 2 m and a typical operating pressure of $10^{-8}$ mbar, then the mean number of collisions is around 3.4.

In order to substantially avoid collisions in the Time of Flight mass analyser, it may be beneficial to reduce the pressure-path length product (PxL) by at least an order of magnitude. It can be seen from Eqn. 1 that the average number of collisions for a given ion is directly related to the pressure-path length product associated with the Time of Flight mass analyser. Therefore, reducing the pressure path length product by reducing the path length traveled by ions within the Time of Flight mass analyser may significantly reduce the number of collisions, and hence reduce the effects of these collisions on the mass spectra.

As noted above, in conventional Time of Flight mass analysis the path length is generally maximised to increase the resolution and avoid other time of flight aberrations associated with short path lengths. However, as can be appreciated from Eqn. 1, for relatively large ions, the time of flight aberrations due to collisions with the background gas may be a major or dominant source of error in the time of flight spectra, and reducing the path length to compensate for this may outweigh any disadvantages associated with the "lost" path length. In general, there may be (for a given mass, mass to charge ratio, or molecular weight) some optimum or otherwise desired path length where the combined error from these competing effects is reduced as far as practical.

On the other hand, species of lower molecular weights typically have a lower collision cross section and therefore experience fewer collisions with the background gas, so these collisions may be a less relevant source of error. For smaller ions, it may generally therefore be beneficial for the ions to travel a longer path length in order to maximise the resolution of the Time of Flight mass analyser. Furthermore, for species having lower molecular weights, reducing the path length may be detrimental to the spectral quality as other time of flight aberrations and sources of error may become more relevant as the flight time is reduced. Thus, for smaller ions, it may be beneficial to keep the path length as long as possible, to maximise the resolution of the Time of Flight analyser.

Accordingly, the techniques described herein relate to an ion analysis instrument that is operable in two or more different modes, wherein the path length in the different modes is selected for the analysis of species of different molecular weights. For example, the instrument may be operable in a first mode having a relatively long path length suitable for the analysis of low molecular weight ions and further operable in a second or further mode having a relatively shorter path length suitable for the analysis of higher molecular weight ions.

As explained above, the substantially optimum path length for a given mass, mass to charge ratio, or molecular weight (or range of mass, mass to charge ratio, or molecular weight) may result from a compromise between using a shorter path length to reduce the effect of collisions and using a longer path length to improve the resolution and reduce other sources of time of flight aberrations. In general, for smaller ions, the substantially optimum path length will be larger than for heavier ions. Thus, the path lengths used in the two modes may be selected based on path lengths that are determined to reduce the total time of flight aberrations for a certain mass, mass to charge ratio, or molecular weight (or range of mass, mass to charge ratio, or molecular weight). Suitable path lengths may be determined empirically, e.g. based on prior calibration experiments, and/or may be constrained by the dimensions of the Time of Flight analyser region. For example, in the first mode, which is arranged for the analysis of lower molecular weight ions, the Time of Flight analyser may be arranged so that the distance traveled by the ions is as long as possible, or at least as long as practical, given the size of the Time of Flight analyser. In the second mode, which is arranged for the analysis of higher molecular weight ions, the distance traveled by the ions may be constrained by the relative positions of the various stages or segments of the Time of Flight analyser. For example, and generally, the distance traveled by the ions within the Time of Flight analyser may be controlled by varying one or more electric fields or potentials that are applied to the various stages or segments of the Time of Flight analyser.

By way of example, according to embodiments of the present disclosure, the Time of Flight analyser comprises a multi-stage reflectron wherein the electric fields or potentials applied to the stages of the reflectron may be varied between the different modes in order to control the distance traveled by ions into the reflectron. That is, in the first mode, the electric fields or potentials applied to the stages of the reflectron may be arranged to allow ions having sufficient energy to travel substantially the whole length of the reflectron (i.e. towards the final stage of the reflectron), whereas in the second mode, the electric fields or potentials applied to the stages of the reflectron may be arranged to force ions to turn around in the first, or an earlier, stage of the reflectron.

FIG. 1 shows schematically a multi-stage or two-stage reflectron Time of Flight mass analyser operating in a first mode arranged for the analysis of low molecular weight ions. In the mode of operation illustrated in FIG. 1, the electric potentials Vr1 and Vr2 applied respectively to the first and second stages of the reflectron 20 are arranged so that ions turn around towards the end of the reflectron 20, and thus travel a relatively long distance within the Time of Flight analyser (path length in FIG. 1=a+b).

Figure 2:
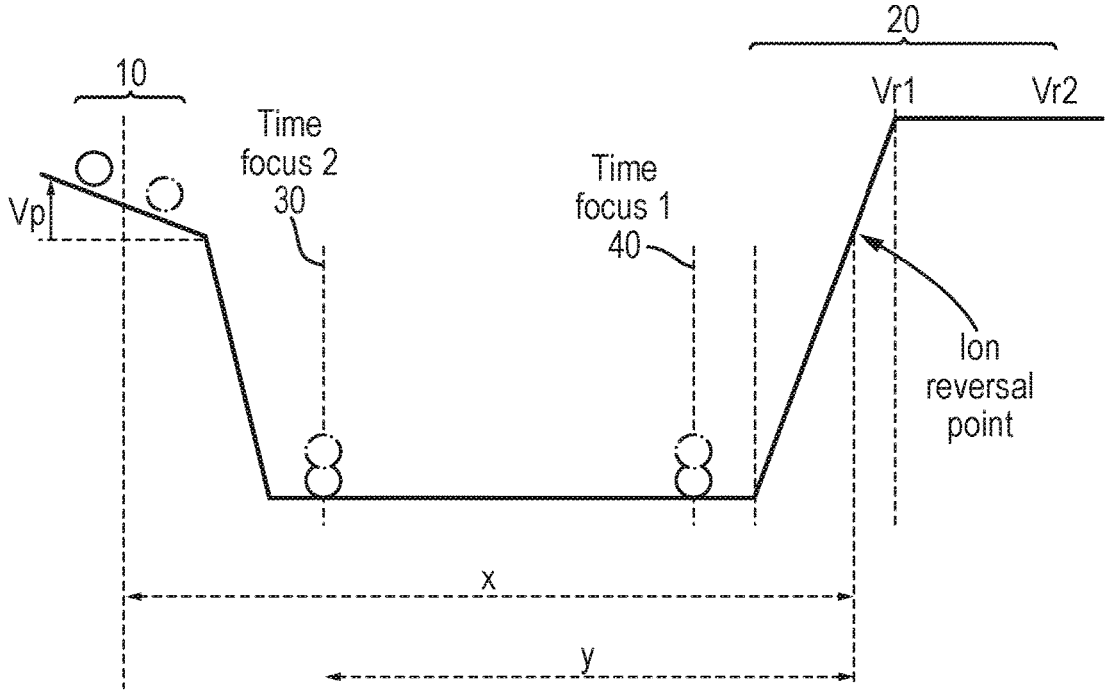
FIG. 2 shows schematically the multi-stage reflectron Time of Flight mass spectrometer of FIG. 1 according to an embodiment and operating in a second mode arranged for analysing ions having high molecular weights.

FIG. 2 shows schematically the same multi-stage reflectron Time of Flight mass analyser as shown in FIG. 1 being operated in a second mode of operation arranged for the analysis of high molecular weight ions. Compared to the first mode of operation shown in FIG. 1, in the second mode of operation shown in FIG. 2, the electric potentials Vr1 and Vr2 applied to the first and second reflectron stages are raised so that ions are caused to turn around within the first stage of the reflectron, and thus the ions therefore travel a relatively shorter distance compared to that of FIG. 1 (path length in FIG. 2=x+y<a+b). Thus, according to various embodiments, the mass spectrometer is selectively operable in a first mode wherein ions are arranged to travel a relatively long distance within the Time of Flight mass analyser and a second mode where ions are arranged to travel a relatively shorter distance within the Time of Flight mass analyser.

As shown in FIGS. 1 and 2, the distance traveled within the Time of Flight mass analyser, or the total path length, may generally be defined as the distance from the mid-point of a pusher region 10 to the ion reversal point in the reflectron plus the distance from the ion reversal point to the detector or detector plane 30. That is, the distance traveled within the Time of Flight mass analyser corresponds with the total actual distance traveled by the ions, rather than an effective path length. The actual distance traveled by the ions generally determines the average number of collisions experienced by the ions.

FIGS. 1 and 2 show a multi-stage reflectron Time of Flight mass analyser according to various embodiments which are similar to that which might be found in currently available systems having a two-stage reflectron 20 where ions turn around between two grids held at respective potentials Vr1 and Vr2. However, by increasing the voltage on Vr1 in a second mode of operation ions are forced to turn around in the first stage of the reflectron such that the ion path length is reduced, as illustrated by FIG. 2.

It will be appreciated that in both modes ions are caused to turn around in the reflectron, such that the reflectron may be used to focus the ions in both modes.

In order to maintain spatial focussing when the path length is varied, the first time focus plane ("time focus 1") 40 may also need to be varied. For example, as shown in FIG. 2, when the path length is reduced, the first time focus plane 40 may accordingly be extended away from the pusher region 10 by reducing the pusher field Vp in the pusher region 10.

Reducing the pusher field Vp may cause an increase in turn-around time (another potential source of Time of Flight aberration), but the requirements for analytical mass resolving power for high molecular weight species are typically lower than for low molecular weight species, so the benefits of reducing the number of collisions may outweigh any increase in turn-around time so that the total or combined error is reduced. For high molecular weight species, the analytical mass resolving power may e.g. be limited to around the peak width of the isotope distribution envelope.

As shown in FIGS. 1 and 2, the Time of Flight mass analyser may comprise a single detector 30 that is arranged to detect ions in each of the first and second modes. To facilitate using the same detector for both modes, the axial energy of the ions may also be adjusted between the first and second modes.

Alternatively, in other embodiments, the mass analyser may comprise multiple detectors e.g. with different detectors being used to detect ions in the different modes. Using separate detectors may allow the detectors to be optimised independently for each mode to account for the axial energy of the ions, etc.

Typically, the detector(s) 30 may be positioned at the or a spatial focus (e.g. of the multi-stage reflectron 20) to reduce time of flight aberrations due to the initial spatial and velocity distributions. The electric fields or potentials on the pusher electrode 10 and/or on the reflectron 20 may be arranged e.g. to focus ions to first or second order, using various known techniques.

In use, the first mode may be used to analyse small or relatively small ions, e.g. those having low or relatively low mass, mass to charge ratio, molecular weight, ion mobility or collision cross section and the second mode may be used to analyse large or relatively large ions, e.g. those having high or relatively high mass, mass to charge ratio, molecular weight, ion mobility or collision cross section. The mass spectrometer may be arranged to select the operating mode based on prior knowledge or expectation or the mass, mass to charge ratio, molecular weight, ion mobility or collision cross section (range) of ions being analysed at a particular time. Alternatively, or additionally, the user may make this selection. For example, the operating mode may be selected based on an upstream mass or mass to charge selective correlated (e.g. ion mobility) separation or filtering, or based on the release of ions from a mass or mass to charge ratio selective ion trap.

Provided that the flight time is long enough, the operating mode may also be switched during the course of recording a single time of flight spectra, e.g. such that the lightest and fastest ions within a particular ion packet are passed to the Time of Flight analyser at a given time are analysed in the first mode whereas slower and heavier ions from the same ion packet are analysed in the second mode.

It is also contemplated that the mass spectrometer may repeatedly and/or cyclically alternate between the different operating modes, in use. Where this is combined with an upstream separation, adjacent (or closely spaced) spectra may be alternately recorded using the first and second modes such that ions arriving at the Time of Flight mass analyser sequentially in time are analysed in alternate modes. Where the switching rate between the different operating modes is fast enough so that spectra in both modes are recorded sufficiently closely together to sample a single eluting peak, ions within the single eluting peak may thus be recorded in both modes. The resulting spectra may be analysed during post-processing to select the peak(s) that are least distorted e.g. for low molecular weight ions, to select the peaks from the spectra obtained using the first mode.

Although FIGS. 1 and 2 show first and second modes for respectively analysing low molecular weight and high molecular weight species, a skilled person will understand that the techniques described herein may also be extended to provide a mass spectrometer that is operable in three or more modes wherein each mode has a different path length (and is hence suitable for different ranges of mass, mass to charge ratio or molecular weight).

Generally, the modes may be discrete modes, wherein the notional or maximum distance traveled by the ions in each mode is fixed. For example, the distance traveled in each mode may be controlled by arranging for ions to travel and/or turn around in different stages of the reflectron, as described above.

Thus, although FIGS. 1 and 2 show a two-stage reflectron, the reflectron may in general have any number of stages, such as three or more.

Figure 3:
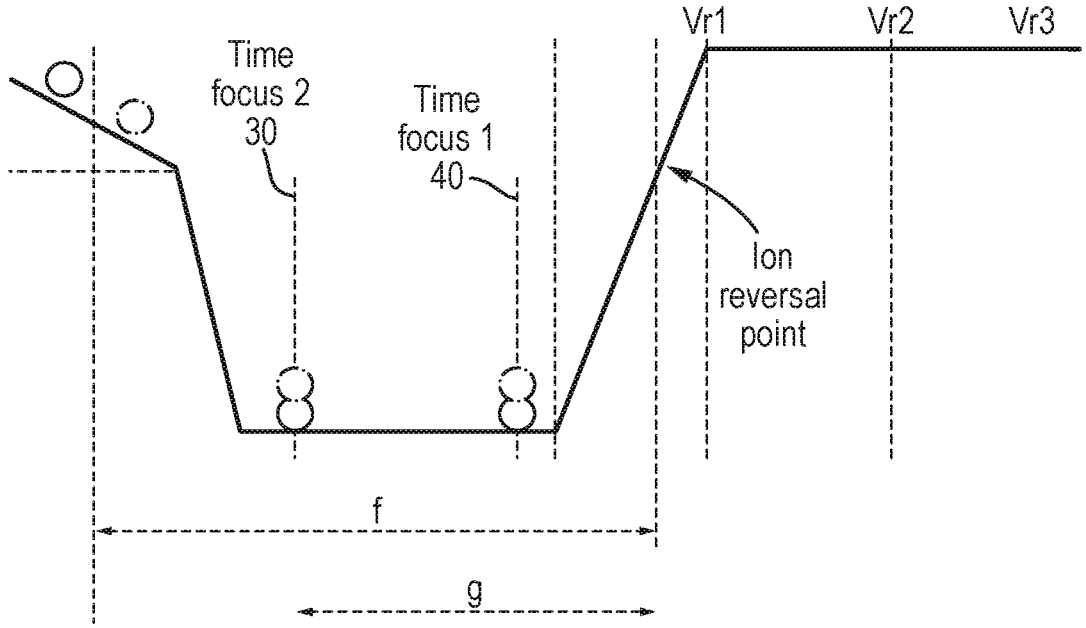
FIG. 3 shows a Time of Flight mass spectrometer with a three-stage reflectron according to an embodiment.

For example, FIG. 3 shows an example of a reflectron having three-stages, with respective grid potentials Vr1, Vr2 and Vr3. Providing additional stages in the reflectron may allow a further reduction in path length between the different modes. For example, the analyser shown in FIG. 3 has the same physical dimensions as that shown in FIGS. 1 and 2, but is provided with a further grid, located closer to the pusher region. Thus, this further grid defines the first stage of the reflectron shown in FIG. 3.

By raising the potential Vr1 on this grid so that the ion reversal point is in this first reflectron stage, the path length may be significantly reduced compared to that in FIG. 2 (path length in FIG. 3=f+g<x+y<a+b).

It will be appreciated that the use of additional reflectron stages may also facilitate providing additional modes of operation, as ions may be forced to turn around in any of the plurality of stages by appropriately adjusting the potentials on each of the stages. Thus, in a first mode, the potential on the first stage may be raised to force ions to turn around in a first stage of the reflectron, whereas in a further mode, the potentials may be adjusted to allow ions to pass through the first stage and turn around in a second, third or later stage of the reflectron.

Figure 4:
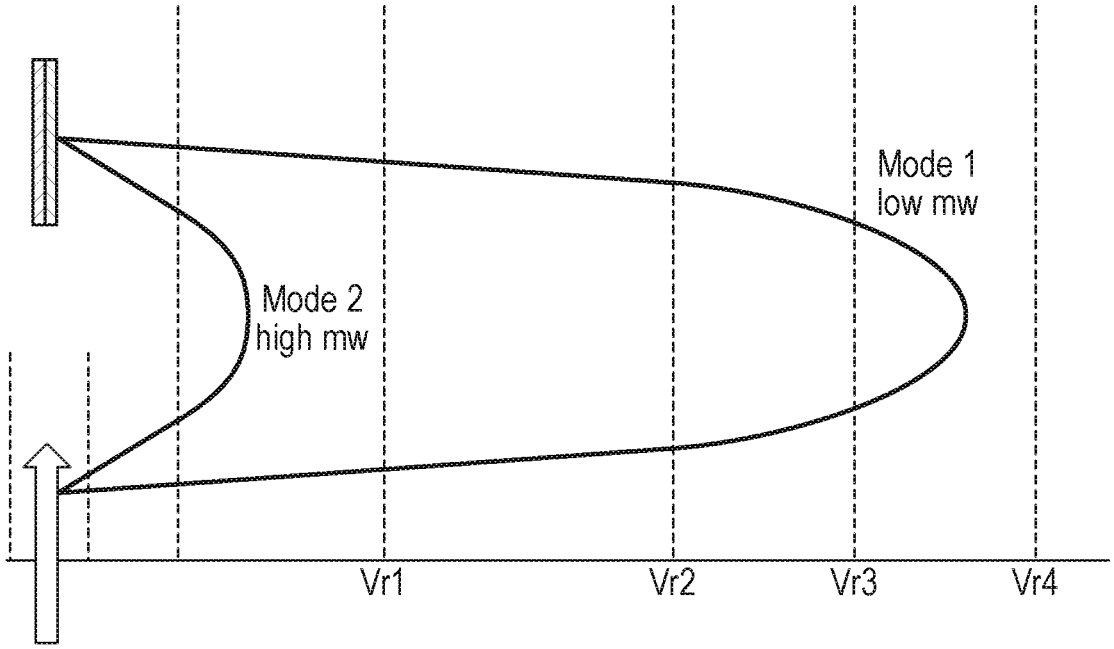
FIG. 4 shows schematically a Time of Flight mass spectrometer system with a four-stage reflectron according to an embodiment and illustrates the significantly reduced path length between the second and first modes of operation.

As another example, FIG. 4 shows a four-stage reflectron, and illustrates the different trajectories of ions in first and second modes. In the first mode shown in FIG. 4, which is arranged for the analysis of low molecular weight species, the potentials on the four stages Vr1,Vr2,Vr3,Vr4 are arranged so that the ions having sufficient axial energy turn around in the fourth stage and the ions have a relatively long path length. However, in the second mode shown in FIG. 4, the first stage potential Vr1 is raised so as to cause ions to turn around in the first stage, significantly reducing the path length.

Various suitable reflectrons may be used to implement the techniques described herein. For example, although the reflectrons shown above comprise grids, it is equally contemplated that the reflectrons may be gridless. Similarly, the reflectrons may comprise one or more ion mirrors, as is illustrated in FIGS. 1-4, or may comprise one or more electrical and/or magnetic sector based or other reflectrons. Furthermore, it will be appreciated that the reflectron need not comprise a "multi-stage" reflectron, and the distance traveled by ions may be controlled by controlling the potential and/or electric field across a single reflectron stage, for instance, by adjusting the gradient or magnitude of the potential.

The techniques described herein may also be applied to multi-turn or multi-pass instruments, e.g. having multiple reflectrons, wherein the ions are arranged to turn around multiple times as they pass between the ion pusher and the ion detector.

The techniques used herein may generally be used with any suitable ion source arrangement. For example, the mass spectrometer may comprise a Matrix Assisted Laser Desorption Ionisation ("MALDI") ion source.

In the embodiments described above the pressure path length product may be varied between the modes by reducing the path length. It will also be appreciated that the pressure-path length product (and hence the average number of collisions) may alternatively or additionally be varied between the modes by varying the pressure. However, reducing the pressure further may be expensive and difficult to maintain for currently available mass spectrometer systems, particularly as there is typically already a fairly high vacuum (between around $10^{-5}$ to $10^{-8}$ mbar) in the analyser region.

Although the present invention has been described with reference to various embodiments, it will be understood by those skilled in the art that various changes in form and detail may be made without departing from the scope of the invention as set forth in the accompanying claims.

The invention claimed is:

1. An ion analysis instrument comprising:

a Time of Flight ("TOF") mass analyser comprising a reflectron, a voltage source configured to provide a first set of electric fields or potentials and a second, different set of electric fields or potentials;

wherein the instrument is selectively operable in at least a first mode and a second mode, wherein in said first mode the first set of electric fields or potentials are applied to the reflectron such that ions are caused to turn around at a first point in the reflectron and wherein in said second mode the second, different set of electric fields or potentials are applied to the reflectron such that ions are caused to turn around at a second point in the reflectron such that the distance travelled by ions within the Time of Flight mass analyser is greater in the second mode than the distance travelled by ions within the Time of Flight mass analyser in the first mode; and a control system arranged and adapted to select between said first and second modes of operation based on the molecular weight, mass or mass to charge ratio, ion mobility or collision cross section of ions being analysed such that:

a first set of ions having a molecular weight, mass or mass to charge ratio, ion mobility or collision cross section above a first value are analysed in said first mode rather than in said second mode; and a second set of ions having a molecular weight, mass or mass to charge ratio, ion mobility or collision cross section below the first value are analysed in said second mode rather than in said first mode.

2. An instrument as claimed in claim 1, wherein said reflectron is a multi-stage reflectron, and wherein in said first mode the first set of electric fields or potentials are applied to the reflectron such that ions are caused to turn around in a first stage of the reflectron and wherein in said second mode the second set of electric fields or potentials are applied to the reflectron such that ions are caused to turn around in a further stage of the reflectron.

3. An instrument as claimed in claim 1, wherein said Time of Flight mass analyser comprises a multi-pass or multi-turn Time of Flight mass analyser, and/or wherein said Time of Flight mass analyser comprises a plurality of reflectrons.

4. An instrument as claimed in claim 1, further comprising a separation or filtering device for separating or filtering ions or analyte material from which the ions derive according to one or more physico-chemical properties prior to their arrival at the Time of Flight mass analyser.

5. An instrument as claimed in claim 4, wherein said one or more physico-chemical properties include molecular weight, mass, mass to charge ratio, or a mass or mass to charge ratio correlated property such as ion mobility or collision cross section.

6. An instrument as claimed in claim 1, wherein the control system is further arranged and adapted to alternately record mass spectra in said first mode and in said second mode.

7. An instrument as claimed in claim 6, wherein said control system is arranged and adapted to repeatedly and/or automatically switch between said first mode of operation and said second mode of operation.

8. An instrument as claimed in claim 1, wherein said Time of Flight mass analyser comprises an acceleration region, and wherein ions are accelerated into the Time of Flight mass analyser by a pusher field applied at said acceleration region, wherein the pusher field is varied between the first and second modes.

9. A method of spectrometry performed using an ion analysis instrument comprising:

a Time of Flight ("TOF") mass analyser comprising a reflectron; and a voltage source configured to provide a first set of electric fields or potentials and a second, different set of electric fields or potentials;

wherein the instrument is selectively operable in at least a first mode and a second mode, wherein in said first mode the first set of electric fields or potentials are applied to the reflectron such that ions are caused to turn around at a first point in the reflectron and wherein in said second mode the second, different set of electric fields or potentials are applied to the reflectron such that ions are caused to turn around at a second point in the reflectron such that the distance travelled by ions within the Time of Flight mass analyser is greater in the second mode than the distance travelled by ions within the Time of Flight mass analyser in the first mode;

the method comprising:

selectively analysing ions in said Time of Flight mass analyser using said first mode and/or using said second mode based on the molecular weight, mass or mass to charge ratio, ion mobility or collision cross-section of ions being analysed such that:

a first set of ions having a molecular weight, mass or mass to charge ratio, ion mobility or collision cross section above a first value are analysed in said first mode, rather than in said second mode; and a second set of ions having a molecular weight, mass or mass to charge ratio, ion mobility or collision cross section below the first value are analysed in said second mode, rather than in said first mode.

10. A method as claimed in claim 9, comprising separating said ions or separating analyte material from which said ions are derived according to molecular weight, mass, mass to charge ratio, or a mass or mass to charge ratio correlated property prior to passing said ions to said Time of Flight mass analyser.

* * * * *